United States Patent [19]

Uchida

[11] Patent Number: 4,952,453

[45] Date of Patent: Aug. 28, 1990

[54] ACRYLIC FIBERS WITH HIGH PHYSICAL PROPERTIES

[75] Inventor: Akiyoshi Uchida, Okayama, Japan

[73] Assignee: Japan Exlan Company Limited, Osaka, Japan

[21] Appl. No.: 203,579

[22] Filed: May 27, 1988

Related U.S. Application Data

[63] Continuation of Ser. No. 889,889, Jul. 25, 1986, abandoned.

[30] Foreign Application Priority Data

| | | | |
|---|---|---|---|
| Aug. 5, 1985 | [JP] | Japan | 60-172682 |
| Jun. 19, 1986 | [JP] | Japan | 61-144626 |
| Jun. 19, 1986 | [JP] | Japan | 61-144627 |

[51] Int. Cl.[5] ..... C08F 20/44

[52] U.S. Cl. ..... 428/364; 428/902; 526/329.2; 526/341; 526/342; 528/487; 528/503; 264/205; 264/206

[58] Field of Search ..... 428/364, 902; 526/341, 526/342; 264/205, 206; 528/503

[56] References Cited

U.S. PATENT DOCUMENTS

| | | | |
|---|---|---|---|
| 4,001,485 | 1/1977 | Patron et al. | 526/342 X |
| 4,140,844 | 2/1979 | Lohwasser | 526/342 X |

FOREIGN PATENT DOCUMENTS

| | | | |
|---|---|---|---|
| 1170011 | 7/1984 | Canada | 526/342 |

*Primary Examiner*—Joseph L. Schofer
*Assistant Examiner*—F. M. Teskin
*Attorney, Agent, or Firm*—Wenderoth, Lind & Ponack

[57] ABSTRACT

Acrylic fibers with high physical properties particularly suitable as material for cement reinforcement are provided by spinning a spinning solution of an acrylonitrile polymer at a particular linear velocity ratio of extrusion, thereby forming gel fibers; regulating the internal water content of the gel fibers, subjecting the fibers to dry-heat treatment under tension or dry-heat stretching under a particular temperature condition; and cooling the fibers under tension.

1 Claim, No Drawings

ACRYLIC FIBERS WITH HIGH PHYSICAL PROPERTIES

This application is a continuation of now abandoned application Ser. No. 889,889, filed July 25, 1986.

BACKGROUND OF THE INVENTION (a) Field of the Invention

This invention relates to acrylic fibers with high physical properties suitable as material for cement reinforcement, and to a method of industrial production of the same.

(b) Description of the Prior Art

Fibers for which high strength and high modulus of elasticity are required have a wide field of use, with the use as reinforcement material being of central importance.

In recent years, as for acrylic fibers, active attempts have been made at the improvement of the physical properties.

As one of such attempts, a method may be mentioned, as described in Japanese Patent Kokai (Laid-open) No. 134,124/79, wherein fibers produced in the usual way are re-stretched in pressurized steam, thereby attaining high stretching times and finally producing fibers with high physical properties.

Another attempt, as represented by Japanese Patent Kokai (Laid-open) No. 199,809/84, is to attain high physical properties by using a superhigh molecular weight polymer as the fiber-forming starting material; arranging polymer molecular chains in parallel in the steps of preparing the spinning solution, spinning the solution into fibers, etc. by various contrivances, thereby bringing the whole molecular chains near to the so-called "stretched-to-full-length" state in the fiber axis direction.

In the above-mentioned re-stretching method in pressurized steam, there are problems in apparatus (such as sealing) and operation, resulting from the use of pressurized steam. This method makes it possible to attain high stretching times by lowering the cohesive force of nitrile groups by the so-called plasticizing effect of water, but on the other hand, it is difficult for this method to exert the original stretching effect of bringing the whole molecular chains near to the "stretched-to-full-length" state, because molecular slipping may occur. For this reason, extremely high stretching times, preferably 35 to 100 times, are necessary as described in the above-mentioned Japanese Patent Kokai (Laid-open) No. 134,124/49. Moreover, such a stretching method in steam is liable to produce microvoids in the fiber structure, and these microvoids obstruct the attainment of high physical properties.

Furthermore, in the method using a superhigh molecular weight polymer, it is necessary to prepare a special polymer which is different from polymers of general use, and with the increase of the degree of polymerization, the viscosity of the polymer solution (spinning solution) increases remarkably, so that the handling, defoaming, spinning, etc. of the solution become difficult. When the polymer concentration of the solution is lowered to lower the viscosity, the productivity and the physical properties of the fibers obtained become low.

Therefore, the object of this invention is to provide acrylic fibers with high physical properties suitable as material for cement reinforcement and a method of producing the same, without the above-mentioned problems.

SUMMARY OF THE INVENTION

The acrylic fibers which make it possible to attain the object of this invention are composed of a polymer containing more than 80 weight % acrylonitrile (hereinafter referred to as AN) and have strength-elongation characteristics determined by the following formulas:

$$8 \leqq TS \quad \text{(I)}$$

$$140 \leqq E \quad \text{(II)}$$

$$TE \leqq 15, \quad \text{(III)}$$

$$1800 \leqq E \times TE \quad \text{(IV)},$$

wherein TS represents tensile strength (g/d), E Young's modulus (g/d), and TE elongation (%).

Such fibers can be produced in an industrially advantageous manner by spinning a spinning solution of the above-mentioned acrylonitrile polymer while maintaining the linear velocity ratio of extrusion (defined below) above 4, water-washing and stretching the extruded gel fibers, subjecting the fibers after stretching to dry-heat treatment under tension or dry-heat stretching at a temperature which permits the maximum stretching times ±30° C., then cooling the fibers under tension, thereby making the effective total stretching times more than 15 times.

$$\text{Linear velocity ratio of extrusion} = \frac{V_o}{V}$$

wherein $V_o$ is linear velocity of extrusion of the spinning solution (m/min), and V is a winding velocity of the extruded gel fibers (m/min).

DETAILED DESCRIPTION OF THE INVENTION

As the AN polymer used in this invention, a polymer insofar as it contains more than 80 weight %, preferably more than 90 weight % of AN, can be used without limitation in its molecular weight, etc. As the other components, there may be mentioned known monomers that can be copolymerized with AN, for example such as methyl, ethyl, butyl, octyl, methoxyethyl, phenyl, cyclohexyl, etc. esters of (meth)acrylic acid; vinyl esters such as vinyl acetate, vinyl propionate, vinyl butyrate, etc.; (meth)acrylamide and derivatives thereof; unsaturated carboxylic acids such as (meth)acrylic acid, maleic acid, itaconic acid, etc. and salts thereof; unsaturated sulfonic acids such as vinylsulfonic acid, (meth)allylsulfonic acid, p-styrenesulfonic acid, acrylamide propanesulfonic acid, and salts thereof; vinyl halides and vinylidene halides such as vinyl chloride, vinyl bromide, vinyl fluoride, vinylidene chloride, vinylidene fluoride, etc.; vinyl compounds such as styrene, ethyl vinyl ketone, methyl, vinyl ether, (meth)allylalcohol, vinyl pyridine, dimethyl aminoethyl methacrylate, vinylidene cyanide, methacrylonitrile, glycidyl (meth)acrylate, etc.

As the solvents for dissolving such a polymer to produce a spinning solution, there may be mentioned organic solvents such as dimethylformamide, dimethylacetamide, dimethyl, sulfoxide, etc. and aqueous solutions of inorganic solvents including thiocyanates such as sodium thiocyanate, potassium thiocyanate, ammonium thiocyanate, etc. and nitric acid, zinc chloride, etc.

For the favorable attainment of this invention by the later-mentioned spinning conditions of this invention, the use of an aqueous solution of an inorganic solvent, among others, a thiocyanate is desirable.

There is no limitation on the polymer concentration, but from the industrial viewpoint, it is desirable to determine it generally at 5–30 weight %, preferably at 7–15 weight %.

In this invention, it is important to conduct spinning while maintaining the linear velocity ratio of extrusion of the spinning solution at above 4, desirably between 5 and 20, and more desirably between 6 and 12. When the ratio is below the lower limit of this range, the stretchability decreases, and if the fibers are not subjected to a special stretching operation such as multistage stretching in a high-boiling-point medium above 100° C., it is impossible for the fibers to attain the necessary effective total stretching times and the finally obtained fibers show only inferior physical properties. When the ratio is above the upper limit of the range, there occur problems such that the use of a deep coagulation bath is necessary, or the physical properties become uneven. Insofar as the filaments are extruded through a spinnerette while satisfying the above-mentioned conditions and are wound (drawn) out of the coagulation bath, not only the usual wet-spinning but also the so-called "dry-wet-spinning" may be employed wherein the filaments are once extruded into an inert atmosphere such as air and subsequently introduced into the coagulation bath.

The extruded gel filaments drawn out of the coagulation bath are then washed with water and stretched.

In the water-washing and stretching steps, the filaments may be cold-stretched and heat-stretched during water-washing (solvent removal) in the usual way or after water washing. Each of the cold and heat stretchings may be conducted in multistage steps.

The water content of the gel filaments immediately after such stretching steps is desirably determined within the range of from 50 to 150%, preferably from 55 to 130%. The means of controlling the water content include the regulation of the polymer concentration in the spinning solution, the temperatures of the coagulation bath, water-washing and stretching. However, by setting the stretching times in the above-mentioned cod and heat-stretching steps at more than 10 times, preferably from 12 to 20 times while taking into account the above-mentioned linear velocity ratio of extrusion, the water content can be controlled advantageously and finally the fibers with high physical properties can be provided in an industrially advantageous manner. Further, by apportioning the cold stretching times and heat stretching times as follows, more desirable results can be obtained:

$$0.25 < \frac{\log A}{\log A + \log B} < 0.60$$

wherein A represents cold stretching times and B heat stretching times.

The filaments thus obtained by spinning, water-washing and stretching may be sent to the succeeding step while maintaining the above-mentioned water content. But it is particularly desirable from the viewpoint of operation to regulate the internal water content of the gel filaments just after stretching to within the range of from 2 to 20%, preferably from 5 to 15% and thereafter to subject the filaments to dry heat treatment under tension or to dry heat stretching.

Among the means for regulating the internal water content, the following means may be mentioned from the industrial viewpoint:

The gel filaments after the heat stretching are dried on heated rolls under tension (with limited shrinkage, preferably in a definite length) successively or under a certain degree of stretching (less than about 1.2 times) so as to regulate the internal water content of the gel filaments to within the prescribed range. The temperature of the heated rolls is desirably set at below about 140° C. preferably within the range of from 60° to 120° C., and for the best results from 70° to 100° C.

When the internal water content is out of the range of this invention, problems in operation are liable to occur, such as filament breakage, lowering of stretchability, etc., especially in the succeeding steps (among others, in the dry heat stretching step).

In The dry heat treatment step under tension or in the dry heat stretching step, the temperature condition is particularly important. It is necessary to set such temperature within the range of the temperature making possible the maximum stretching ±30° C., preferably ±20° C. (The temperature making possible the maximum stretching means the temperature at which the maximum stretching times can be obtained without causing filament breakage in the dry heat stretching step.) Only by satisfying such a temperature condition can the filament manifest the high physical properties which have been given to the filaments in the previous steps. When the temperature is out of this range, it is possible to produce the fibers of this invention. For the attainment of the object of this invention, it is desirable to dry-heat stretch the filaments more than 1.05 times, preferably from 1.1 to 2.5 times, and for the best results, from 1.2 to 2.3 times.

In this invention, it is important to cool the filaments under tension subsequently. As for such a tension condition, it is desirable to stretch more than 1.02 times, preferably 1.05 times so that the filaments after dry heat treatment under tension or dry heat stretching may not be relaxed and lowered in physical properties while they are cooled to room temperature, or may not be wound around the rollers. If the filaments are heat-set after dry heat stretching and before cooling under tension, the physical properties can be further improved. The recommended heat-set condition is dry heat between 180° and 250°0 C., preferably under a definite length.

For the acrylic fibers produced in the above-mentioned steps under the above-mentioned condition, it is necessary to determine a stretching condition so that the effective total stretching time should be finally above 15 times, preferably above 18 times, and for the best results above 20 times. By satisfying these requirements, acrylic fibers with high physical properties can be finally produced without any problems in operation, and in an industrially advantageous manner.

The temperature making possible the maximum stretching varies greatly depending on the polymer composition, polymer molecular weight, spinning condition, etc., so that it is impossible to fix it definitely. However, in the case of a polymer with a practical polymer composition and molecular weight, for example AN≧85 weight % and weight average molecular weight of from 70,000 to 250,000, the temperature generally varies within the range of from 140° to 180° C.

The precise value of such a temperature is obtained as follows: For example, the dry heat stretching temperature for the sample fibers is gradually changed and the stretching times for each temperature at which the fibers are broken are obtained. Thus the dry heat stretching temperature giving the maximum stretching times can be obtained.

In this way, it is possible to provide industrially advantageous acrylic fibers having strength-elongation characteristics of a tensile strength (TS) generally above 8 g/d, preferably above 10 g/d, a Young's modulus (E) above 140 g/d, preferably above 150 g/d, an elongation (TE) less than 15%, preferably less than 12%, and a product of Young's modulus and elongation (E×TE) above 1800.

We do not fully understand why acrylic fibers with such high physical properties can be provided industrially advantageously by employing the above process requirements in combination. However, the reason is supposed to be as follows:

The solvent removal and coagulation speed due to the spinning under the condition of the linear velocity ratio of extrusion recommended in this invention can bring the polymer molecular structure in the extruded gel filaments to such a state in which excellent stretching and orientation can be obtained in the following stretching step. Further, the succeeding water-washing and stretching and the subsequent dry heat treatment under tension or dry heat stretching under a particular temperature condition as well as the cooling which comes next aid in bringing the molecular chains of the finally formed filaments into parallel arrangement near the "stretched-to-the-full-length" chains, without forming voids in the fiber structure. Thus the high physical properties can be manifested.

It is an effect of this invention worthy of special mention that a method of producing acrylic fibers with high physical properties has been provided industrially advantageously, without any problems in operation, without preparing a special polymer as the fiber-forming starting material, and without using as an essential means a stretching step in pressurized steam which has problems in apparatus, in operation, and in physical properties.

It is also a characteristic advantage of this invention that, since there is not need of using a spinning solution of high viscosity, there is no difficulty in the handling of the solution or in the operation of defoaming and spinning, and that the invention has provided a means which does not necessitate lowering of the polymer concentration (which may lower the productivity and fiber physical properties) to avoid such difficulties.

Furthermore, the acrylic fibers of this invention retain a moderate elongation contrary to common knowledge, and have a high strength and modulus of elasticity. Therefore, when the fibers are used, for example, as a cement reinforcement material, the fibers can withstand the stress such as shear and bend upon dispersion, molding or shrinkage of cement. Also, the fibers can minimize the cracks generated during the use of the cement reinforced with the fibers, thus improving the tenacity. Moreover, the fibers of the invention have an advantage of elevating the impact strength of the reinforced cement.

Thus, the acrylic fibers of this invention can be widely used for a variety of industrial uses including reinforcement materials for resin and cement, tire cords, precursors for carbon fibers, ropes, etc. Therefore, the usefulness of the fibers of this invention is very large.

EXAMPLES OF THE PRACTICE OF THE INVENTION

For a better understanding of the invention, examples of the practice of the invention are shown in the following. However, this invention is not limited in scope by these examples. Percentages in the examples are by weight unless otherwise indicated.

REFERENTIAL EXAMPLE 1

An AN copolymer composed of 90% AN and 10% methyl acrylate (MA) and having an intrinsic viscosity [$\eta$] in dimethylformamide at 30° of 1.4, was dissolved in an aqueous 50% sodium cyanate solution, to prepare a spinning solution of a polymer concentration of 10% (the viscosity at 30° C.: 55 poises).

The spinning solution at 80° C. was extruded into an aqueous 15% sodium cyanate solution at −3° C. through a spinnerette (50 orifices, diameter of each orifice: 0.05 mm), and the resulting filaments were wound at various linear velocity ratios of extrusion, as described in Table 1. The filaments were then cold-stretched 3.0 times and thereafter heat-stretched in boiling water, thereby to obtain the maximum heat-stretching times.

The results are shown in Table 1.

TABLE 1

| | No. | | | | | | | |
|---|---|---|---|---|---|---|---|---|
| | 1 | 2 | 3 | 4 | 5 | 6 | 7 | 8 |
| Linear velocity ratio of extrusion | 3.0 | 4.0 | 5.0 | 6.0 | 8.0 | 10.0 | 12.0 | 15.0 |
| Cold-stretching times | (2.5)* | 3.0 | 3.0 | 3.0 | 3.0 | 3.0 | 3.0 | 3.0 |
| Maximum heat-stretching times | 4.0 | 4.0 | 4.3 | 6.0 | 6.9 | 7.1 | 7.3 | 8.0 |
| Total stretching times | 10.0 | 12.0 | 12.9 | 18.0 | 20.7 | 21.6 | 21.9 | 24.0 |

*Cold stretching times were lowered because filament breakage occurred.

It is understood from the above Table that, by increasing the linear velocity ratio of extrusion, the total stretching times (maximum stretching times allowing stretching (cold×heat) without causing filament breakage) can be remarkably increased.

REFERENTIAL EXAMPLE 2

Water-swollen gel filaments (internal water content:73%) were produced in the same way as in Referential Example 1 to No. 5 except that the heat-stretching times were 5.3 times.

Then, sample fibers were dried under a definite length on heated rolls of 80° C. so that the internal water content could become 10%, and the fibers were heat-stretched at various temperatures of the heated rolls, as described in Table 2. Thus the maximum stretching times (dry-heat stretching times at breakage) at each temperature was obtained.

The results are shown in Table 2.

TABLE 2

| Dry heat stretch temperature (°C.) | 125 | 135 | 140 | 148 | 150 | 152 | 155 | 165 | 180 | 190 | 200 | 220 |
|---|---|---|---|---|---|---|---|---|---|---|---|---|
| Maximum stretch times | 1.2 | 1.45 | 1.75 | 2.0 | 2.1 | 2.0 | 1.95 | 1.35 | 1.25 | 1.2 | 1.3 | 1.2 |

It is understood from the above Table that the temperature allowing the maximum stretching times is 150° C.

EXAMPLE 1

The sample fibers described in Referential Example 2 (however, the heat-stretching times were 4.0 times) were dry-heat stretched under the condition described in Table 3, and 6 kinds of fibers (A–F) were produced.

The physical properties of these fibers were measured and the results are shown in Table 3.

All these fibers showed good operability, without causing filament breakage upon dry-heat stretching. But when undried sample fibers (internal water content:73%) and sample fibers dried to an internal water content of 1%, were dry-heat stretched in the same way as Fiber D, there was remakable filament breakage and it was impossible to continue operation.

TABLE 3

| | Fiber | Dry-heat stretch Temp. (°C.) | Dry-heat stretch Times | Stretch times on cooling | Fiber physical properties: Tensile strength (g/d) | Modulus of elasticity (g/d) | Elongation (%) |
|---|---|---|---|---|---|---|---|
| Fibers of the invention | A | 150 | 1.1 | 1.1 | 8.3 | 147 | 12.3 |
| | B | 150 | 1.2 | 1.25 | 9.8 | 165 | 10.5 |
| | C | 150 | 1.6 | 1.05 | 10.7 | 178 | 10.7 |
| | D | 150 | 1.8 | 1.05 | 11.8 | 189 | 10.2 |
| Fibers for comparison | E | 150 | 1.2 | No tension | 7.6 | 124 | 12.4 |
| | F | 200 | 1.2 | 1.1 | 7.0 | 114 | 13.6 |

From the above Table, it is clearly understood that the fibers of this invention have excellent physical properties, and that when the dry-heat stretching temperature is outside the range of this invention (Fiber F, and Fiber E cooled without tension), it was impossible to obtain fibers with high modulus of elasticity and high elongation.

EXAMPLE 2

In the same way as Example 1 Fiber C except that the linear velocity ratio of extrusion was varied as shown in Table 4, three kinds of fibers (G, H, and I) were produced. The internal water content and physical properties were measured. The results are shown in Table 4.

TABLE 4

| Fiber | L.V.R. of extrusion | Internal water content (%) | Effective total stretching times | Fiber physical properties: Tensile strength (g/d) | Modulus of elasticity (g/d) | Elongation (%) |
|---|---|---|---|---|---|---|
| G | 3.5 | 55 | 14.7* | 7.3 | 125 | 12.4 |
| H | 6.0 | 80 | 20.2 | 10.6 | 174 | 10.6 |
| I | 10.0 | 117 | 20.2 | 10.7 | 179 | 10.8 |

*Note:
Since stretching was impossible because of filament breakage, the fiber was produced by 2.5 times cold-stretching and 3.5 times stretching in boiling water.

From the above Table, it is clear that the fibers of this invention have excellent physical properties and that when the linear velocity ratio of extrusion is outside the range of this invention (Fiber G), fibers with high physical properties could not be obtained owing to inferior stretchability.

EXAMPLE 3

Fibers J and K were produced in the same way as Example 1 Fiber D except that the molecular weight of the AN copolymer was changed to [η]:1.8, or the composition was changed to 97% AN and 3% MA, and that, as the dry-heat stretching temperature, temperatures allowing the maximum stretching shown in Table 5 were employed.

TABLE 5

| Fiber | Viscosity of spinning solution (poises) | Internal water content (%) | Temp. allowing the max. stretching (°C.) | Physical properties: Tensile strength (g/d) | Modulus of elasticity (g/d) | Elongation (%) |
|---|---|---|---|---|---|---|
| J | 220 | 110 | 175 | 12.4 | 202 | 10.6 |
| K | 70 | 115 | 160 | 12.1 | 195 | 10.1 |

From the above Table, it is clearly understood that the fibers of this invention have excellent physical properties.

What is claimed is:

1. Acrylic fibers with high physical properties composed of a polymer containing at least 85 weight % acrylonitrile with a weight average molecular weight of from 70,000 to 250,000, and having strength-elongation characteristics specified by the following formulas (I)--(IV):

$$10 \leqq TS \quad \text{(I)}$$

$$140 \leqq E \quad \text{(II)}$$

$$TE \leqq 15 \quad \text{(III)}$$

$$1800 \leqq E \times TE \quad \text{(IV)}$$

wherein TS represents tensile strength (g/d), E represents Young's modulus (g/d), and TE represents elongation (%), said fibers being produced by a method which comprises spinning a spinning solution of a polymer containing at least 85 weight % acrylonitrile while maintaining the linear velocity ratio of extrusion (defined below) at above 4; water-washing and stretching the thus-obtained gel filaments; subjecting the filaments after stretching to dry-heat treatment under tension or dry-heat stretching under the temperature condition of the temperature making possible the maximum stretching ±30° C.; and thereafter cooling the filaments under tension so that the effective total stretching times will become more than 15 times, the linear velocity ratio of extrusion being defined as follows:

$$\text{Linear velocity ratio of extrusion} = \frac{V_o}{V}$$

wherein $V_o$ represents the linear velocity of extrusion (m/min) of the spinning solution, and V represents the winding speed (m/min) of the extruded gel filaments.

* * * * *